US011259620B2

(12) United States Patent
Morales et al.

(10) Patent No.: US 11,259,620 B2
(45) Date of Patent: Mar. 1, 2022

(54) ACCESSORY STORAGE DEVICE

(71) Applicants: Maria Morales, Harrison, NJ (US); Danny N. Concepcion, Harrison, NJ (US)

(72) Inventors: Maria Morales, Harrison, NJ (US); Danny N. Concepcion, Harrison, NJ (US)

( * ) Notice: Subject to any disclaimer, the term of this patent is extended or adjusted under 35 U.S.C. 154(b) by 163 days.

(21) Appl. No.: 16/526,583

(22) Filed: Jul. 30, 2019

(65) Prior Publication Data

US 2021/0030139 A1 Feb. 4, 2021

(51) Int. Cl.

| | |
|---|---|
| ***A45D 40/18*** | (2006.01) |
| ***A44C 5/00*** | (2006.01) |
| ***A44C 9/00*** | (2006.01) |
| *A45D 40/00* | (2006.01) |

(52) U.S. Cl.

CPC ..... *A45D 40/18* (2013.01); *A44C 5/003* (2013.01); *A45D 2040/0012* (2013.01)

(58) Field of Classification Search

CPC ..... A45D 40/18; A45D 2040/0012; A45D 33/33; A44C 5/003; A44C 9/0069; A44C 15/003; A44C 9/0061; A44C 5/0007; A45F 2005/008; A45F 5/00

See application file for complete search history.

(56) References Cited

U.S. PATENT DOCUMENTS

| | | | | | |
|---|---|---|---|---|---|
| 1,664,994 | A * | 4/1928 | Augustin | A44C 17/02 | 63/15 |
| 3,559,854 | A * | 2/1971 | Loveland | A45D 33/18 | 224/219 |
| 2013/0014312 | A1* | 1/2013 | Izkovitz | A44C 9/0069 | 2/160 |
| 2015/0216285 | A1* | 8/2015 | Grainger | A45D 40/18 | 206/581 |

FOREIGN PATENT DOCUMENTS

| | | | | |
|---|---|---|---|---|
| DE | 4238056 | A1 * | 5/1994 | A44C 5/003 |
| FR | 819512 | A * | 10/1937 | A44C 5/003 |
| FR | 1495516 | A * | 9/1967 | A44C 9/0069 |
| FR | 2661662 | A1 * | 11/1991 | G04B 37/1433 |
| FR | 2807298 | A3 * | 10/2001 | A45D 40/22 |
| GB | 466988 | A * | 6/1937 | A44C 5/003 |
| GB | 1299856 | A * | 12/1972 | G04B 39/025 |

* cited by examiner

*Primary Examiner* — Jack W Lavinder
(74) *Attorney, Agent, or Firm* — Gearhart Law LLC

(57) ABSTRACT

The present invention generally relates to wearable jewelry and storage devices. Specifically, this invention relates to wearable jewelry having the ability to store materials, including cosmetic makeup materials lotions and perfumes.

16 Claims, 3 Drawing Sheets

ACCESSORY STORAGE DEVICE

FIELD OF THE INVENTION

The present invention generally relates to wearable jewelry and storage accessories. Specifically, this invention relates to storage accessories having the ability to store materials, including cosmetic makeup materials, lotions, and perfumes.

BACKGROUND

The use of accessories to enhance or showcase individual style is universal. Some accessories provide utility by coupling to storage containers, permitting a user to wear the storage container as an accessory piece, such as a bracelet or necklace. Conventional storage containers coupled to wearable elements are connected to each other by latches, hooks, or other interlocking assemblies. However, such accessories do not provide a convenient and efficient means of easily replacing the storage containers attached thereto.

Therefore, there is a need in the art for a storage device which provides a convenient and efficient means of removing and replacing the storage accessory cartridge, as desired by a user. These and other features and advantages of the present invention will be explained and will become obvious to one skilled in the art through the summary of the invention that follows.

SUMMARY OF THE INVENTION

Accordingly, it is an object of the present invention to provide an accessory device capable of storing makeup, lotions, perfume and similar materials.

Embodiments of the present invention include a device and method of using the device. In accordance with embodiments of the present invention, provided is an accessory device with an efficient detachable and replaceable cartridge or storage receptacle for storing makeup, lotions, perfume and similar materials.

The foregoing summary of the present invention with the preferred embodiments should not be construed to limit the scope of the invention. It should be understood and obvious to one skilled in the art that the embodiments of the invention thus described may be further modified without departing from the spirit and scope of the invention.

BRIEF DESCRIPTION OF THE DRAWINGS

Accompanying this written specification is a collection of drawings of example embodiments of the present invention. One of ordinary skill in the art would appreciate that these are merely exemplary embodiments, and additional and alternative embodiments may exist and still be within the scope and spirit of the invention as described herein.

To facilitate understanding, identical reference numerals have been used, wherever possible, to designate identical elements that are common to the figures. It is contemplated that elements of one embodiment may be beneficially incorporated in other embodiments without further recitation.

DETAILED DESCRIPTION

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

Embodiments of the present invention are generally directed toward an accessory device with an efficient detachable and replaceable storage element such as a cartridge.

A wearable storage device 100 in accordance with an embodiment of the present invention generally includes a base or carrier 106 and a storage element, for example, a cartridge 101. The wearable storage device is adapted to receive and store cosmetic makeup, such as lip stick, lip gloss and mascara, lotions, perfumes and the like within a cartridge which may be reversibly engaged with jewelry such as necklaces, bracelets, broaches and anklets, and accessories such as book bags, purses, and belts. Advantageously, having the aforementioned materials stored in an easily removeable and replaceable cartridge serves several functions, including, but not limited to, providing a means for a user to optionally store and carry the materials on their person during various activities, without requiring the use of a purse or a pocket, and providing a means for easily removing and exchanging the cartridge from the base of the accessory device, for replacement with a new cartridge or a cartridge storing an alternative material, such as alternate makeup options. For example, the replaceable cartridge may be attached to an accessory device such that the contents of the replaceable cartridge are accessible during daily activities, including when a user is at home, work, or partaking in athletic activities.

Figure 1:
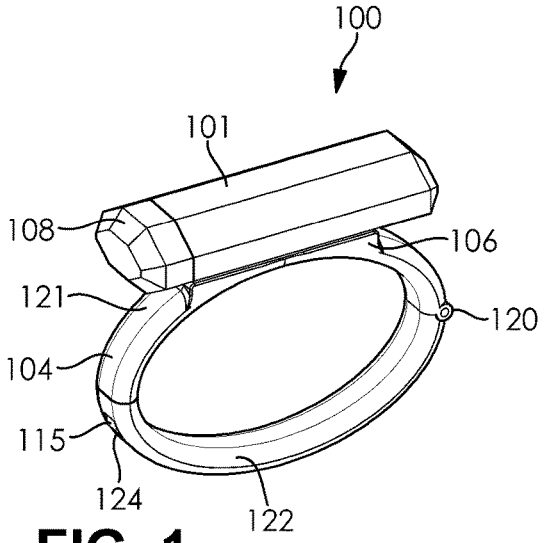
FIG. 1 shows a top front perspective view of an accessory storage device in accordance with an embodiment of the present invention.

Referring generally to the figures, an accessory storage device 100 in accordance with embodiments of the present invention is shown. As shown in FIG. 1, a wearable storage device 100 may be configured to comprise a base or carrier 106, engageable with a cartridge 101 having at least one cavity 113, and a fastening means to reversibly fasten the cartridge 101 to the base or carrier 106 of the device 100.

According to embodiments of the present invention, the cartridge 101 may have a round, square, or multi-angular front or side cross section. In some embodiments, the exterior appearance of the cartridge 101 may be round, square, oval or any other shape or configuration.

As shown in FIGS. 1-5, according to embodiments of the present invention, a cartridge or storage receptacle 101 is configured to removably engage with the base 106. A fastening means enables the reversible engagement of the cartridge 101 to the base 106.

Figure 5:
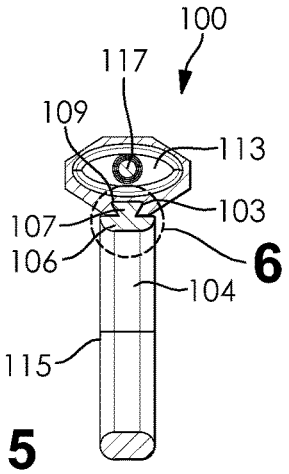
FIG. 5 shows a side cross sectional view of an accessory storage device in accordance with an embodiment of the present invention.
Figure 6:
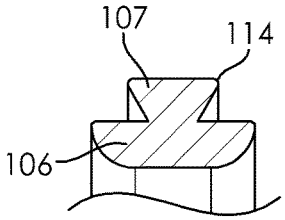
FIG. 6 shows an exploded view of FIG. 6, showing a cross sectional view of a base and a locking protrusion of an accessory storage device in accordance with an embodiment of the present invention.
Figure 13:
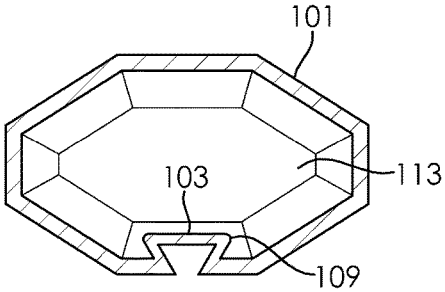
FIG. 13 is a side cross sectional view of a cartridge of an accessory storage device in accordance with an embodiment of the present invention.
Figure 14:
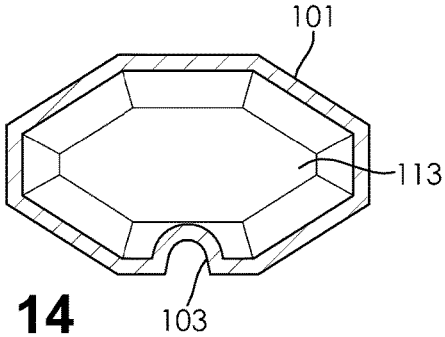
FIG. 14 is a side cross sectional view of a cartridge of an accessory storage device in accordance with an embodiment of the present invention.

As shown in FIGS. 5, 6, 7 and 9, in accordance with an exemplary embodiment of the present invention, the fastening means is a storage element receiver, for example, a locking protrusion 114 extending from a top portion of the base 106 and engageable with a side wall of cartridge 101. As shown in FIGS. 5, 13 and 14, in some embodiments, a side wall of cartridge 101 includes a notch 103, engageable with the locking protrusion 114. In some embodiments, at least a portion of the locking protrusion 114 may extend past and overhang the band 104. In some embodiments, the locking protrusion 114 may be slightly curved. The notch 103 may be positioned on a bottom side of the cartridge 101 which is perpendicular to the longitudinal axis of the cartridge 101. The locking protrusion 114 may be configured to fit in the notch 103 of the cartridge 101. The locking protrusion 114 may comprise a substantially tubular, round, square, or trapezoidal longitudinal profile. As shown in Figs. In some embodiments, the locking protrusion 114 may comprise one or more elongated extensions 107 adapted to fit within one or more elongate indentations 109 in notch 103.

As generally shown in the figures, in accordance with an exemplary embodiment of the present invention, the dimensions of the locking protrusion 114 and the notch 103 permit the locking protrusion 114 to friction fit within the notch 103 thereby permitting the cartridge 101 to maintain its engagement with the base 106 while the device 100 is worn by a user. Further, the cartridge 101 may slidably engage with the base 106. For example, a user may engage the cartridge 101 with the base 106 by sliding the cartridge 101 onto the base 106. Alternatively, a user may slide the cartridge 101 off of the base 106 to disengage the cartridge 101 from the base 106 in order to remove the cartridge 101 from the base 106. This enables a user to easily remove and replace one cartridge for another cartridge, as desired by the user. In some embodiments, the locking protrusion 114 is disposed on a bottom side of the cartridge 101 and is engageable with a notch incorporated at the top of the base 106. In some embodiments, similarly suitable fastening means are envisioned which may be similarly utilized to easily and reversibly engage the cartridge 101 to the base 106.

According to embodiments of the present invention, a magnet may be disposed within the base 106, engageable with a magnet disposed on the cartridge 101. Additionally, the base 106 may comprise at least one screw or snap latch to reversibly secure the cartridge 101 to the base 106. The cartridge 101 may be reversibly locked to the base 106 when the snap latch is engaged. Alternatively, the snap latch may be disengaged, and the cartridge 101 may be separated from (i.e. not secured to) the base 106.

Figure 7:
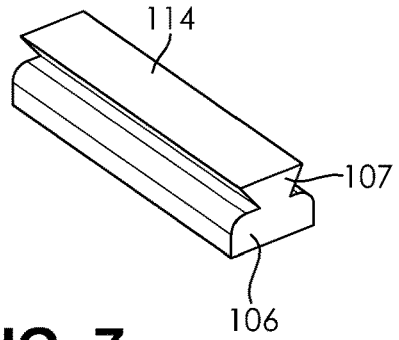
FIG. 7 shows a top front perspective view of a base and a locking protrusion of an accessory storage device in accordance with an embodiment of the present invention.

According to embodiments of the present invention, the base 106 and the locking protrusion 114 are substantially comprised of the same or similar material such as plastic, metal, or wood. As shown in FIG. 7, in some embodiments, the base 106 and the locking protrusion 114 are one continuous piece. In some embodiments, the base 106 and the locking protrusion 114 are comprised from a composite of materials. The different options of material in the manufacture of the base 106 allow for aesthetically pleasing variations that can be worn as fashion pieces.

According to embodiments of the present invention, the cartridge 101 may be reflective. In some embodiments, the cartridge 101 may be a mirror. In some embodiments, at least a portion of the base 106 may include a mirror. In some embodiments, at least a portion of a side wall of the cartridge 101 may include a mirror. In some embodiments, the exterior surface of the cartridge 101 may be a mirror.

Figure 2:
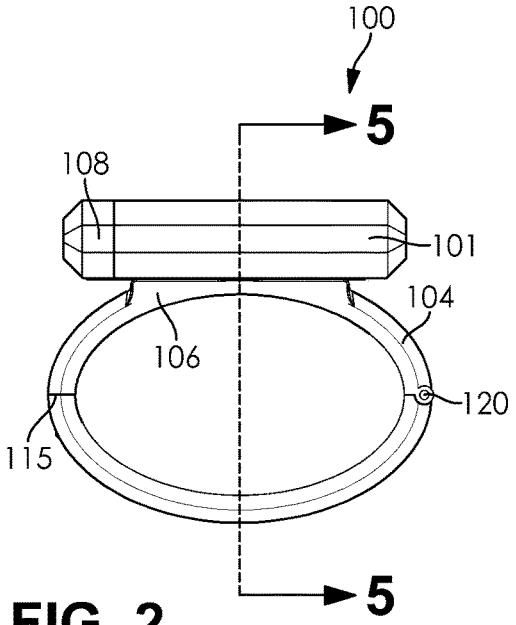
FIG. 2 shows a front view of an accessory storage device in accordance with an embodiment of the present invention.
Figure 3:
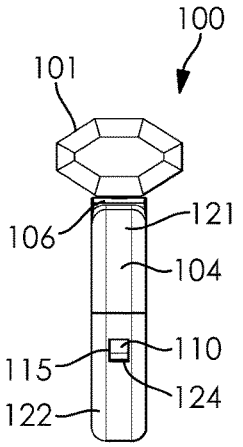
FIG. 3 shows a right side view of an accessory storage device in accordance with an embodiment of the present invention.
Figure 4:
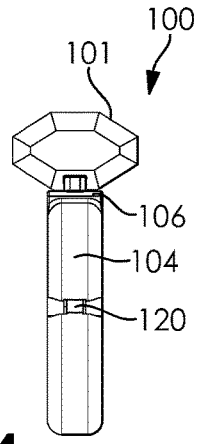
FIG. 4 shows a left side view of an accessory storage device in accordance with an embodiment of the present invention.
Figure 15:
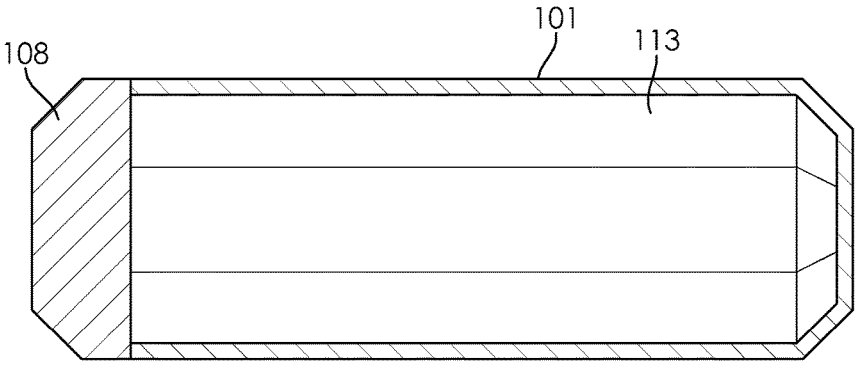
FIG. 15 is a top cross sectional view of a cartridge of an accessory storage device in accordance with an embodiment of the present invention.

As shown in FIG. 15, according to an exemplary embodiment of the present invention, the one or more cavities 113 may be configured as internal compartments. As shown in FIGS. 1-2 and 15, in some embodiments, each compartment includes a sealing means or cap, to reversibly seal at least a portion of each internal compartment. A cap 108 may fit flush over the opening of each cavity 113 or internal compartment, and may be removable, providing access to an inner portion of cartridge 101. In some embodiments, the cap 108 may include a depression, adapted to engage with the locking protrusion 114 along with the cartridge 101, such that the cap 108 and the cartridge 101 may be reversibly fastened to the base 106.

In accordance with embodiments of the present invention, various substances may be stored within the internal compartments of the cartridge 113, including but not limited to makeup such as lip balm (i.e. ChapStick®), lip stick, ointments, eye shadows, eye liners, creams, lotions, perfume and similar products. One of ordinary skill in the art would appreciate that any number of makeup materials could be used with embodiments of the present invention, and embodiments of the present invention are contemplated for use with makeup, lotion, perfume, cologne and similar materials.

According to embodiments of the present invention, the cap 108 may snap on to the cartridge 101 via a snap latch, to reversibly seal the cartridge 101. Alternatively, the cap 108 may be configured to pivotally engage with the cartridge 101. The cartridge 101 and the cap 108 may be threaded to permit the cap 108 to screw onto the opening of the cartridge 101. One of ordinary skill in the art would appreciate that any number of means of reversibly sealing the cartridge could be used with embodiments of the present invention, and embodiments of the present invention are contemplated for use with reversible sealing means.

Figure 8:
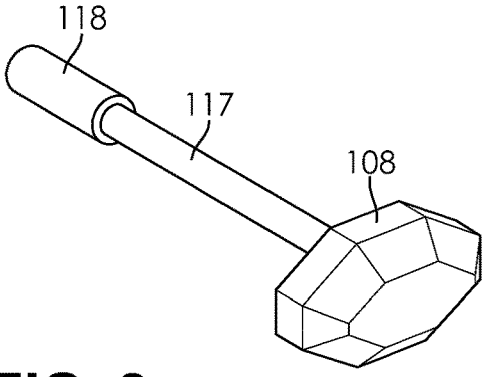
FIG. 8 shows a top perspective view of a cap and an applicator of an accessory storage device in accordance with an embodiment of the present invention.
Figure 9:
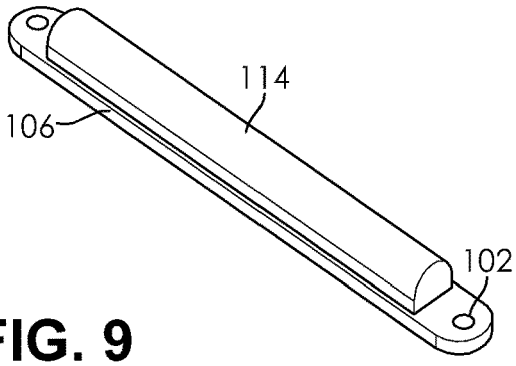
FIG. 9 shows a top perspective view of a base and a locking protrusion of an accessory storage device in accordance with an embodiment of the present invention.

As shown in FIGS. 5 and 8, in accordance with embodiments of the present invention, an applicator 117 for applying cosmetic makeup may extend from an inner portion of the cap 108. One end of the applicator 117 may include a soft material which is capable of holding and spreading makeup materials such as lip gloss and eyeshadow. In some embodiments, the soft material may be a brush 118 for example, for applying makeup such as lip gloss or mascara. In some embodiments, the applicator 117 is a pencil, such as a pencil for applying eye or lip liners of a variety of colors.

In accordance with embodiments of the present invention, the cap 108 may comprise a spray nozzle or similar mechanism for spraying liquid contents such as perfume, air freshener or cologne placed within the cavity 113. In some embodiments, the cavity may contain a mouth freshener, which may be similarly sprayed or applied using a spray nozzle.

As shown in FIGS. 1-5, according to embodiments of the present invention, the base 106 may extend from a top portion of the band 104. The base 106 may provide support for the cartridge 101 and stabilize its position along the band 104. In some embodiments, the base 106 may be attached to the band 104. In accordance with an exemplary embodiment of the present invention, to facilitate the attachment of the base 106 to the band 104, the base 106 may possess one or more through holes. The through holes may be adapted to receive retaining members on end caps which extend from the band 104. For example, the base 106 may comprise two through holes positioned substantially across one another, parallel to the longitudinal axis of base 106 with each end cap of the band 104 coupled to each through hole. One of ordinary skill in the art would appreciate that the base 106 may be attached to the band 104 in any number of ways, and embodiments of the present invention are contemplated for use with any such manner of attachment.

According to embodiments of the present invention, the band 104 may comprise a fastener 115 or any similar locking mechanism to facilitate the opening and closing of the band 104. In some embodiments, the fastener 115 comprises a clip 110 configured to engage with a hollow channel 111 in the band 104. In some embodiments, the clip 110 is configured to latch onto an opening 124 in the hollow channel 111, to lock the band 104 in a closed position. In some embodiments, the fastener 115 is a snap closure for clasping or securing one portion of the band 104 to another portion of the band 104. A user may wear the device by first unfastening the snap closure to create an opening large enough to allow for insertion of a wrist, ankle or similar body part so that the band 104 and base 106 may be refastened to substantially encircle the desired body part.

According to embodiments of the present invention, the band 104 may be composed of a substantially resilient material. In some embodiments, the band 104 may be substantially flexible. For example, the band 104 may be substantially comprised of fabric, plastic, nylon, cloth, metal, rubber or any composite of the foregoing materials. The band 104 may include a joint or hinge 120 configured to permit rotational movement of the upper portion 121 and lower portion 122 of the band 104 along the axis of the joint 120. One of ordinary skill in the art would appreciate that any number of bands could be used with embodiments of the present invention, and embodiments of the present invention are contemplated for use with any such bands.

According to embodiments of the present invention, the length, size, or circumference of the band 104 includes a size adjustment mechanism such as a buckle and corresponding loops, similar to that of a belt or a watch band. One of ordinary skill in the art would appreciate that any number of size adjustment mechanisms could be used with embodiments of the present invention, and embodiments of the present invention are contemplated for use with any type of size adjustment mechanisms.

In some embodiments, the band 104 may be stylized or designed with characters, colors, pictures, or patterns. In some embodiments, the design of the band is customizable. In some embodiments, the band 104 is adorned with charms. In some embodiments, the charms are stylized. In some embodiments, the band 104 includes one or more clips, buttons or similar attachment members for attaching one or more pictures, characters, colors or patterns to the band 104.

Figure 10:
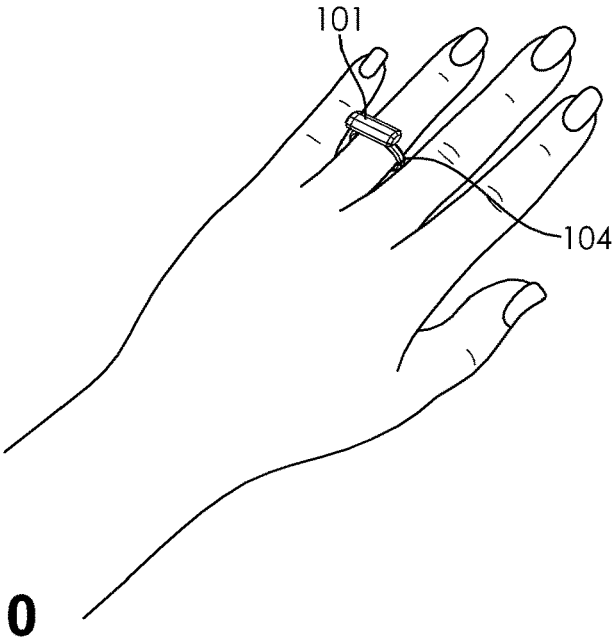
FIG. 10 shows an accessory storage device in use as a ring, in accordance with an embodiment of the present invention.
Figure 11:
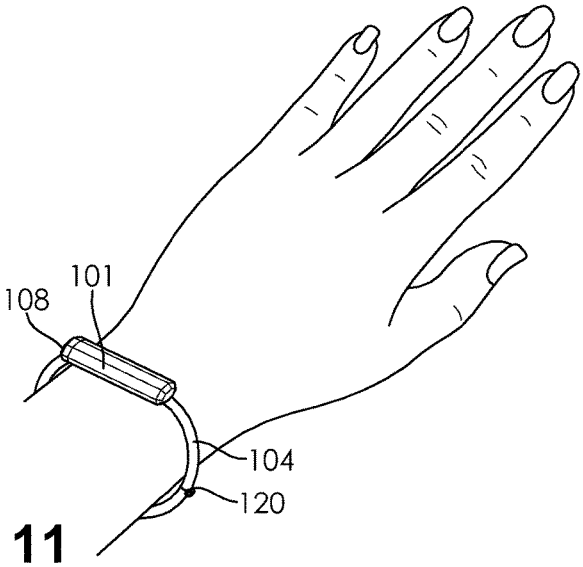
FIG. 11 shows an accessory storage device in use as a bracelet, in accordance with an embodiment of the present invention.
Figure 12:
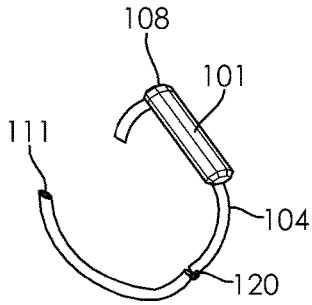
FIG. 12 shows an accessory storage device with a band in an "open" position, in accordance with an embodiment of the present invention.

According to embodiments of the present invention, cartridge 101 and base 106 may be configured for use as jewelry such as necklaces, bracelets, anklets, rings, broaches, charm pins or any similar type of adornment. As shown in FIG. 10, in some embodiments, the cartridge 101 and base 106 may be configured for use as a ring. As shown in FIG. 11, in some embodiments, the cartridge 101 and base 106 may be used as a bracelet. Similarly, the cartridge 101 and base 106 may be configured for use with any type of accessory such as backpacks, handbags, clip belts, and any similar type of accessory. One of ordinary skill in the art would appreciate that any number of accessories could be used with embodiments of the present invention, and embodiments of the present invention are contemplated for use with any type of adornment or accessory.

Advantageously, several of the contemplated embodiments provide for an efficient storage of cosmetics while simultaneously functioning as an article of jewelry. While the foregoing is directed to embodiments of the disclosure, other and further embodiments of the disclosure may be devised without departing from the spirit and scope of the invention.

The invention claimed is:

1. An accessory storage device, comprising:

a storage element comprising an opening and a side wall having a recess configured to engage a storage element receiver, wherein said storage element has an interior chamber configured to selectively receive liquid and/or solid matter, and wherein the sidewall is a bottom side of the storage element;

a base protruding from a circular element, the base having a top surface, said top surface coupled to said storage element receiver;

wherein said storage element receiver is directly affixed to the storage element via the recess; and wherein the storage element receiver is configured to prevent movement of the storage element.

2. The accessory storage device of claim 1, wherein said storage element receiver slidably engages with at least a portion of said side wall.

3. The accessory storage device of claim 1, wherein said storage element receiver friction fits within at least a portion of said side wall.

4. The accessory storage device of claim 1, wherein said storage element receiver snap fits into at least a portion of said side wall.

5. The accessory storage device of claim 1, wherein said interior chamber is selectively covered by a cap.

6. The wearable storage device of claim 5, wherein said cap comprises an applicator.

7. The wearable storage device of claim 5, wherein said cap threadably engages with said storage element.

8. The wearable storage device of claim 5, wherein said cap pivotably engages with said storage element.

9. The accessory storage device of claim 8, wherein each of said interior chamber and said cap engages with the said storage element to prevent said cap from rotating independently of said storage element.

10. An accessory storage device, comprising:

a storage element comprising an opening and a side wall comprising a notch on a bottom of said storage element adapted to engage with a storage element receiver;

wherein said opening is associated with cavities forming interior chambers configured to selectively receive liquid and solid matter;

a base protruding from a circular member, the base having a top surface coupled to said storage element receiver;

wherein said circular element has a first section pivotally coupled to a second section; and wherein said storage element receiver is directly affixed to the storage element via said notch.

11. The accessory storage device of claim 10, wherein said storage element receiver slidably engages with said notch.

12. The accessory storage device of claim 10, wherein said storage element receiver friction fits within said notch.

13. The accessory storage device of claim 10, wherein storage element receiver snap fits into said notch.

14. An accessory storage device, comprising:

an elongate storage element comprising an opening, an opaque cap, and a side wall adapted to engage with a storage element receiver, wherein the opaque cap is pivotally coupled to an end of the elongate storage element, wherein said opening is associated with at least one cavity forming an interior chamber within the elongate storage element configured to selectively receive liquid and/or solid matter, and wherein the cavity extends along a length of the elongate storage element;

a base protruding from a circular element, the base having a top surface configured to couple to said storage element receiver;

wherein said circular element has a first section coupled, by a pivotal coupling, to a second section with a locking mechanism configured to secure the first section and the second section opposite the pivotal coupling;

wherein said storage element is configured to engage with the said storage element receiver and said opaque cap for selectively closing said opening; and wherein said storage element receiver is directly affixed to the storage element via a recess.

15. The wearable storage device of claim 14, wherein said opaque cap further comprises an applicator.

16. The accessory storage device of claim 14, wherein each of the said cavities and the said opaque cap engage with the said storage element to prevent said opaque cap from rotating independently of said storage element.

* * * * *